United States Patent [19]

Freeny, Jr. et al.

[11] Patent Number: 4,561,848

[45] Date of Patent: Dec. 31, 1985

[54] ELECTRONIC AMMUNITION FOR SIMULATING LIVE AMMUNITION DETONATION

[75] Inventors: Charles C. Freeny, Jr., Fort Worth; Ronald J. Rabin, Mansfield, both of Tex.

[73] Assignee: Power Technology Partners, Ltd., Oklahoma City, Okla.

[21] Appl. No.: 528,143

[22] Filed: Aug. 31, 1983

[51] Int. Cl.[4] ..... F41F 27/00

[52] U.S. Cl. ..... 434/18; 102/529

[58] Field of Search ..... 434/16, 18, 19, 48, 434/11; 273/310–313; 102/529, 444, 501, 374, 376, 430, 473, 498; 272/14

[56] References Cited

U.S. PATENT DOCUMENTS

| | | | |
|---|---|---|---|
| 4,023,078 | 5/1977 | Olliges et al. | 434/48 |
| 4,302,190 | 11/1981 | Shaw et al. | 434/18 |
| 4,365,439 | 12/1982 | Litynski | 273/310 |

FOREIGN PATENT DOCUMENTS

| | | | |
|---|---|---|---|
| 2445505 | 8/1980 | France | 273/310 |

*Primary Examiner*—Richard C. Pinkham
*Assistant Examiner*—Leo P. Picard
*Attorney, Agent, or Firm*—Dunlap, Codding & Peterson

[57] ABSTRACT

The present invention contemplates electronic ammunition for simulating live ammunition detonation when utilized with an ammunition firing device having a mechanism for firing ammunition when triggered wherein an electronic sound assembly is disposed within a component space within a shell and the shell is loaded within the ammunition firing device. The electronic sound assembly has recorded therein the sound of the detonation of live ammunition and is adapted for providing the live ammunition sound in an audibly perceivable form in a play mode in response to receiving a triggered signal. The electronic ammunition includes a firing assembly which has a portion which is engagable with the firing mechanism of the ammunition firing device so that, when the electronic ammunition is loaded into the ammunition firing device and when the ammunition firing device is triggered, the triggering of the firing assembly causes the firing assembly to produce the triggered signal which is received by the electronic sound assembly and, in response to receiving the triggered signal, the electronic sound assembly is conditioned in the play mode for providing the live ammunition sound in an audibly perceivable form. The electronic ammunition of the present invention also contemplates a recoil assembly being included as a portion of the electronic ammunition and the recoil assembly is adapted to impart a simulated recoil action to the ammunition firing device in response to receiving the triggered signal.

12 Claims, 1 Drawing Figure

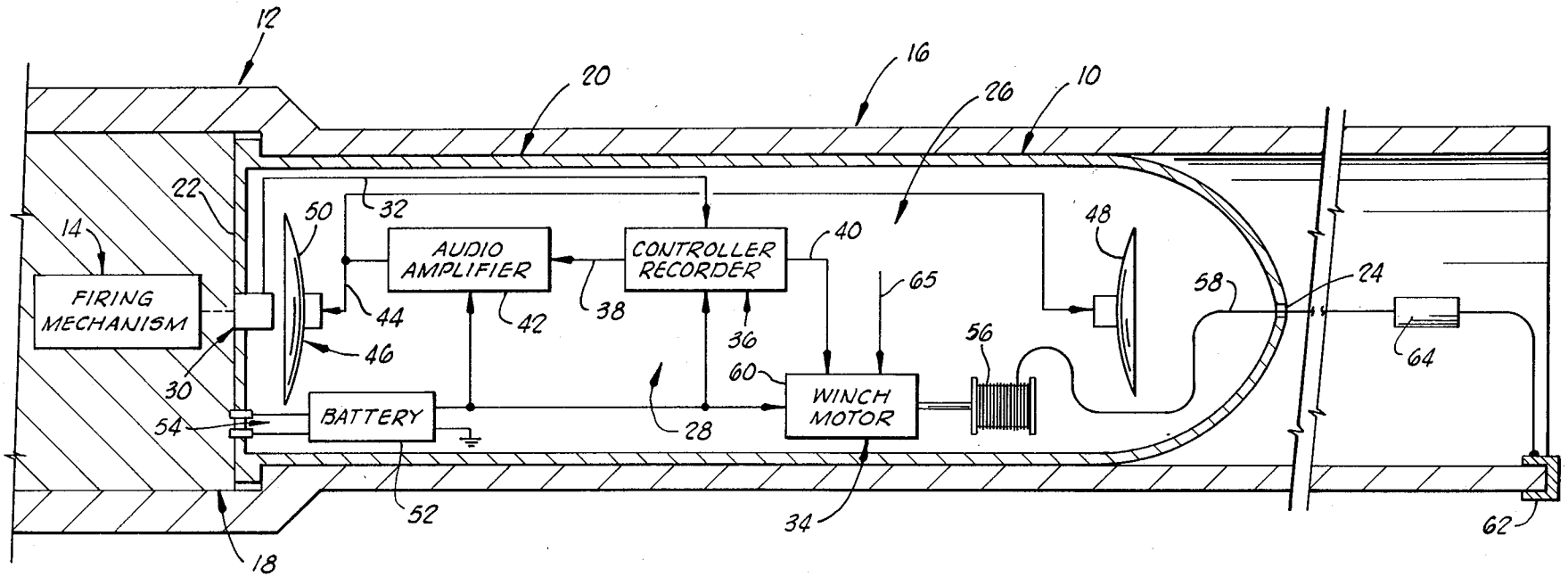
WINCH MOTOR
CONTROLLER RECORDER
AUDIO AMPLIFIER
BATTERY
FIRING MECHANISM
10
12
14
16
18
20
22
24
26
28
30
32
34
36
38
40
42
44
46
48
50
52
54
56
58
60
62
64
65

ELECTRONIC AMMUNITION FOR SIMULATING LIVE AMMUNITION DETONATION

BACKGROUND OF THE INVENTION

1. Field of the Invention

The present invention relates generally to blank ammunition which simulates the sound and recoil resulting from the detonation of live ammunition without causing a projectile to be fired or released from the ammunition firing device and, more particularly, but not by way of limitation, to an electronic ammunition for simulating the detonation of live ammunition when utilized with an ammunition firing device having a mechanism for firing ammunition when triggered, the electronic ammunition providing the live ammunition sound in an audibly perceivable form in response to the triggering of the ammunition firing device.

BRIEF DESCRIPTION OF THE DRAWING

The single figure in the drawing is a diagrammatic, schematic view of electronic ammunition which is constructed in accordance with the present invention and showing a portion of the ammunition firing device in which the electronic ammunition is loaded.

DESCRIPTION OF THE PREFERRED EMBODIMENT

In many instances and particularly in training circumstances, blank ammunition is utilized. In the past, the blank ammunition has been adapted to simulate the sound and recoil action of live ammunition when detonated by the firing mechanism of the ammunition firing device without a projectile being released from the ammunition firing device. Blank ammunition of this type has been used in various types of ammunition firing devices, such as rifles, guns, bazookas, mortars, or cannons, for example. After the blank ammunition has been fired, the blank ammunition no longer has been usable unless reloaded. The cost of providing new or reloaded blank ammunition has been relatively expensive and the present invention particularly contemplates an electronic ammunition firing device which is reusable without reloading in a conventional sense, thereby providing ammunition which may be used and reused in training circumstances, for example, without the substantial cost incurred in replacing or reloading prior blank ammunition.

Shown in FIG. 1 is an electronic ammunition 10 which is constructed in accordance with the present invention for simulating live ammunition detonation when utilized with an ammunition firing device, a portion of an ammunition firing device being diagrammatically shown in FIG. 1 and designated therein by the general reference numeral 12. The term "ammunition firing device" as used herein contemplates an ammunition firing device of the type commonly referred to in the art as a rifle, gun, bazooka, mortar, or cannon, for example, and it is intended that the term "ammunition firing device" encompass any device which is capable of firing live ammunition when triggered. The firing mechanism of the ammunition firing device 12 is diagrammatically shown in FIG. 1 and designated therein by the reference numeral 14, a portion of the barrel of the ammunition firing device 12 also is diagrammatically shown in FIG. 1 and designated therein by the reference numeral 16, and a portion of the case of the ammunition firing device 12 also is diagrammatically shown in FIG. 1 and designated therein by the reference numeral 18, the electronic ammunition 10 being schematically and diagrammatically shown in FIG. 1 in a loaded position in the ammunition firing device 12.

The electronic ammunition 10 includes a shell 20 having a rearward end 22, a forward end 24 and a component space 26 which is formed within the shell 20 generally between the rearward and the forward ends 22 and 24 thereof. The shell 20 substantially encompasses the component space 26 and the shell 20 has an overall shape simulating the shape of the live ammunition to be simulated, the shell 20 being particularly adapted and shaped for loading the shell 20 in the ammunition firing device 12 in a manner substantially like live ammunition is loaded into the ammunition firing device 12.

The rearward end 22 portion of the shell 20 may be removably connected to the base portion of the shell 20 (not shown) so that the rearward end portion 22 can be removed from the remaining portion of the shell 20 to provide access to the component space 26 for installing the various electronic components in the component space 26 and to provide access for removing the electronic components from the component space 26 for repair or replacement, if desired in a particular application. Also, tne forward end 24 portion of the shell may be removably connected to the remainder of the shell (not shown) to facilitate the installation and repair of portions of the electronic ammunition 10, if desired in a particular application.

The electronic ammunition 10 includes an electronic sound assembly 28 which is disposed within the component space 26 in the shell 20, the electronic sound assembly having the sound of the live ammunition recorded therein (live ammunition sound) and adapted for providing the live ammunition sound in an audibly perceivable form in a play mode of the electronic sound assembly 28 in response to receiving a triggered signal. The particular sound which is recorded in the electronic sound assembly 28 simulates the particular sound of the simulated live ammunition when detonated. For example, if the electronic ammunition 10 is intended to simulate live ammunition for use with a bazooka, the live ammunition sound recorded in the electronic sound assembly 28 will simulate the sound of a bazooka shell when detonated by a bazooka (ammunition firing device). Sounds of other live ammunition for use in other ammunition firing devices are recorded in the electronic sound assembly 28 in a like manner when the electronic ammunition 10 is intended to simulate live ammunition for such other ammunition firing devices.

The electronic ammunition 10 also includes a firing assembly 30 which is supported in the rearward end 22 portion of the shell 20 with a portion of the firing assembly 30 being exposed to the exterior of the shell 20 in a manner and in a position like a "cap" in live ammunition. More particularly, the portion of the firing assembly 30 which is exposed to the exterior of the shell 20 is positioned to be mechanically engagable with a portion of the firing mechanism 14 of the ammunition firing device 12 when the electronic ammunition 10 is disposed or loaded in the ammunition firing device 12 and when the ammunition firing mechanism 14 is triggered.

The firing assembly 30 is adapted to provide the triggered signal on an output signal path 32 in response to the firing assembly 30 being engaged by the firing mechanism 14 when the firing mechanism 14 is triggered. The firing assembly 30 could be any device capable of providing an electrical or mechanical signal (triggered signal) in response to a mechanical impulse imparted thereto by the firing mechanism 14 when the firing mechanism 14 is triggered and, for example, the firing assembly 30 could constitute a pressure switch which is adapted to provide an electrical or mechanical signal in response to a mechanical impulse being imparted thereto by the firing mechanism 14 when the firing mechanism 14 is triggered.

The electronic ammunition 10 also includes a recoil assembly 34 which is adapted to receive the triggered signal and to impart a simulated recoil action to the ammunition firing device 12 in response to receiving such triggered signal. It should be noted that in some applications, it may be desirable to construct the electronic ammunition 10 without the recoil assembly 34 where only the sound of the live ammunition is to be simulated which may be desirable in some applications.

The electronic sound assembly 28 includes a controller recorder 36 and the controller recorder 36 has recorded therein the live ammunition sound. The controller recorder 36 preferably is an electronic chip or "micro processor" and the live ammunition sound is recorded in the electronic chip or "micro processor" in a digital form. However, it should be noted that, in some applications, the controller recorder 36 also could be of a tape player type of construction and the live ammunition sound could be recorded on tape for play back by the tape player, although the electronic chip or "micro processor" is the preferred form of construction. In any event, the controller recorder 36 has a "play mode" and, in the play mode, the controller recorder 36 is adapted to provide an output signal for a predetermined period of time on a signal path 38 of the live ammunition sound recorded in the recorder controller 36 in response to receiving the triggered signal on the signal path 32. Also, in response to receiving the triggered signal on the signal path 32, the controller recorder 36 is adapted to provide the triggered signal on an output signal path 40 to be received by the recoil assembly 34, in a manner which will be described in greater detail below. It should be noted that, although the signal provided on the signal path 40 is referred to herein as the "triggered signal", this signal may not be an exact duplicate of the triggered signal received on the signal path 32 from the firing assembly 30; however, the signal provided by the controller recorder 36 on the signal path 40 is provided at about the same time as the triggered signal is received by the controller recorder 36 on the signal path 32 and the controller recorder 36 output signal on the signal path 40 does function in the nature of the triggered signal to cause the recoil assembly to impart a simulated recoil action to the ammunition firing device 12, the controller recorder 36 output signal on the signal path 40 being particularly adapted to be electrically compatible with the recoil assembly 34 for activating the recoil assembly 34, in a manner which will be more apparent in view of the further description of the recoil assembly 34 below.

The controller recorder 36 particularly is adapted to provide the live ammunition sound on the signal path 38 in an analog form, the controller recorder 36 functioning to convert the recorded live ammunition sound in a digital form to an analog form prior to providing the live ammunition sound in an analog form on the output signal path 38. This last mentioned conversion function provided by the controller recorder 36 is applicable when the controller recorder 36 is an electronic chip or "micro processor" and the live ammunition sound is recorded in the controller recorder 36 in a digital form. It will be apparent to those skilled in the art that, if the live ammunition sound is recorded in the controller recorder 36 in an analog form, the conversion function just described would not be a necessary function of the controller recorder 36 in that particular electronic ammunition 10 application.

The controller recorder 36 output signal on the signal path 38 of the live ammunition sound is connected to and received by an audio amplifier 42. The audio amplifier 42 functions to amplify the live ammunition sound received from the controller recorder 36 and to provide the amplified live ammunition sound on an output signal path 44.

The electronic sound assembly 28 includes a speaker assembly 46. The speaker assembly 46 includes a forward speaker 48 which is disposed near the forward end 24 of the shell 20 and the forward speaker 48 is adapted to receive the amplified live ammunition sound on the signal path 44 and to provide the live ammunition sound in an audibly perceivable form. The forward speaker 48 is oriented to project the live ammunition sound in a forward direction generally from the rearward end 22 toward the forward end 24 of the shell 20.

The speaker assembly 46 also includes a rearward speaker 50 which is disposed near the rearward end 22 of the shell 20. The rearward speaker 50 is adapted to receive the live ammunition sound on the signal path 44 and to provide the live ammunition sound in an audibly perceivable form. The rearward speaker 50 is oriented to project the live ammunition sound in a rearward direction generally from the forward end 24 toward the rearward end 22 of the shell 20. The orientation of the forward and the rearward speakers 48 and 50 to project the live ammunition sound in the forward and the rearward direction with respect to the shell 20 orientation in the ammunition firing device 12 cooperates to more nearly simulate or duplicate the sound of live ammunition when detonated as would be perceived by an individual firing the ammunition firing device 12.

The controller recorder 36, the audio amplifier 42 and the speakers 48 and 50 cooperate to provide the live ammunition sound for a predetermined period of time and at a predetermined volume level for simulating the sound of live ammunition when detonated.

The ammunition firing device 10 includes a battery 52 which is connected to ground and to the audio amplifier 42, the controller recorder 36 and the recoil assembly 34 for providing electrical operating power to the audio amplifier 42, the controller recorder 36 and the recoil assembly 34. The battery 52 includes a pair of recharge leads 54 which are connected to the battery 52 and to the rearward end 22 of the shell 20, portions of the recharge leads 54 extending through the rearward end 22 of the shell 20. Thus, an individual can connect a battery recharging device (not shown) to the portion of the recharging leads 54 extending through the rearward end 22 of the shell 20 for recharging the battery 52.

It should be noted that, in lieu of utilizing the battery 52, the various electrical and electronic components of the electronic ammunition 10, such as the audio amplifier 42, the controller recorder 36, and the recoil assembly 34 each can be connected to a lead or conductor (not shown) which extends through the shell 20 and is connected to a cord (not shown) such that the cord can extend from the electronic ammunition 10 and be connected to an external source of electrical energy (not shown) thereby eliminating the need for having a battery, such as the battery 52, or for recharging, which may be desired in some applications of the electronic ammunition 10 of the present invention.

In a preferred form, and as shown in the drawing, the various electrical and electronic components comprising the forward and the rearward speakers 48 and 50, the audio amplifier 42, the controller recorder 36, the recoil assembly 34, and the battery 52 each are disposed and supported within the component space 26 in the shell 20.

The recoil assembly 34, in one preferred form, includes a winch base 56, a winch wire 58 and a winch motor 60. The winch motor 60 is an electrical motor which is drivingly connected to the winch base 56 for rotating the winch base 56 in a winding direction in one condition of the winch motor 60 and for rotating the winch base 56 in an opposite unwinding direction in one other condition of the winch motor 60. One end of the winch wire 58 is secured to the winch base 56 and, thus, when the winch motor 60 is conditioned to drivingly rotate the winch base 56 in the winding direction, the winch wire is wound onto the winch base 56 and, when the winch motor is conditioned to drivingly rotate the winch base 56 in the opposite unwinding direction, the winch wire 58 is unwound from the winch base 56.

A clamp 62 is secured to the end of the winch wire 58, opposite the end of the winch wire 58 which is connected to the winch base 56, and the clamp 62 is secured to the barrel 16 of the ammunition firing device 12, thereby securing the winch wire 58 to the ammunition firing device 12. A recoil weight 64 is interposed in the winch wire 58, the recoil weight 64 having a predetermined weight value.

The winch motor 60 is adapted to receive a rewind signal on a signal path 65 which may be provided by the controller recorder 36 or which may be provided by a device external from the shell 20 of the ammunition firing device 12, the winch motor 60 being adapted to be conditioned for drivingly rotating the winch base 56 in the winding direction in response to receiving the rewind signal on the signal path 65. In addition, the winch motor 60 also is adapted to receive the triggered signal on the signal path 40 provided by the controller recorder 36 and the winch motor 60 is adapted to be conditioned to drivingly rotate the winch base 56 in the unwinding direction in response to receiving the triggered signal on the signal path 40. Preferably, the winch motor 60 includes controls for drivingly rotating the winch base 56 in the winding direction until a predetermined tension has been placed in the winch wire 58 as the winch wire 58 is wound about the winch base 56 as a result of the driving rotation imparted by the winch motor 60.

It should be noted that the recoil assembly 34 could be spring loaded or otherwise controlled to automatically place a predetermined tension in the winch wire 58 and the winch motor 60 could be connected to the winch base 56 to automatically and momentarily release the predetermined tension in the winch wire 58 in response to receiving the triggered signal on the signal path 40. In this embodiment, the winch motor 60 per se would not have to receive the rewind signal on the signal path 65, since the recoil assembly 34 would function to automatically wind the winch wire 58 to a position wherein the predetermined tension was placed in the winch wire 58.

The rearward end 22 of the shell 20 is adapted to be securedly positioned or locked in position within the ammunition firing device 12 when the electronic ammunition 10 is loaded into the ammunition firing device 12, as generally illustrated in the drawing. In other words, the shell 20 is adapted to be secured or locked into position within the ammunition firing device 12 in a manner exactly like that of live ammunition when such live ammunition is loaded into the ammunition firing device 12.

In operation, the shell 20 is loaded into the ammunition firing device 12 and securedly positioned within the ammunition firing device 12. The clamp 62 is secured to the barrel 16 thereby securing one end of the winch wire 58 to the barrel 16 of the ammunition firing device 12. The rewind signal on the signal path 65 is generated and passed to the winch motor 60 and, in response to receiving the rewind signal on the signal path 65, the winch motor 60 drivingly rotates the winch base 56 in the winding direction thereby winding the winch wire 58 about the winch base 56 until a predetermined tension has been placed in the winch wire 58. Since the shell 20 is secured within the barrel 16 of the ammunition firing device 12, the winding of the winch wire 58 about the winch base 56 tends to pull the shell 20 in a direction toward the open end of the barrel 16; however, since the rearward end 22 of the shell 20 is secured in the ammunition firing device 12, this action results in tensioning the winch wire 56.

When the ammunition firing device 12 is actuated or triggered by an individual or otherwise, the firing mechanism 14 of the ammunition firing device 12 is triggered, thereby causing a portion of the firing mechanism 14 to mechanically engage the firing assembly 30 and, in response to being engaged by the firing mechanism 14, the firing assembly 30 functions to provide the triggered signal on the signal path 32. The triggered signal on the signal path 32 is received by the controller recorder 36 and, in response to receiving the triggered signal, the controller recorder 36 operates to provide the live ammunition sound on the signal path 38 and to provide the triggered signal on the signal path 40. The live ammunition sound on the signal path 38 is amplified by the audio amplifier 42 and the amplified live ammunition sound then is provided to the forward and rearward speakers 48 and 50 which function to provide the live ammunition sound in an audibly perceivable form thereby audibly simulating the detonation of live ammunition. Simultaneously, the triggered signal on the signal path 40 is received by the winch motor 60 and, in response to receiving the triggered signal, the winch motor 60 is conditioned for drivingly rotating the winch base in the unwinding direction thereby unwinding the winch wire 58 from the winch base 56 and rapidly relieving the tension in the winch wire 58. The unwinding of the winch wire 58 or, more particularly, the rapid relieving of the tension in the winch wire 58 cooperates to impart a simulated recoil action in the ammunition firing device, the extent or degree of the recoil action being controlled by the degree of tension in the winch wire together with the predetermined weight of the recoil weight 64.

Changes may be made in the electronic ammunition or in the various element, components, and assemblies of the electronic ammunition as described herein without departing from the spirit and the scope of the invention as defined in the following claims.

What is claimed is:

1. Electronic ammunition for simulating live ammunition detonation when utilized with an ammunition firing device having a firing mechanism for firing ammunition when triggered, comprising:

a shell having a rearward end, a forward end, and a component space disposed generally between the forward and rearward ends thereof;

an electronic sound assembly disposed in the component space in the shell having the sound of the live ammunition recorded therein (live ammunition sound) and adapted for providing the live ammunition sound in an audibly perceivable form in a play mode of the electronic sound assembly, the electronic sound assembly being conditioned in the play mode in response to receiving a triggered signal;

a firing assembly having a portion engagable with the firing mechanism of the ammunition firing device when the electronic ammunition is loaded in the ammunition firing device and when the ammunition firing device is triggered and another portion adapted to provide a triggered signal to the electronic sound assembly in response to the firing assembly being engaged by the ammunition firing device, thereby conditioning the electronic sound assembly in the play mode; and a recoil assembly disposed in the component space in the shell having a portion adapted for receiving the triggered signal from the firing assembly and being adapted to impart a simulated recoil action to the ammunition firing device in response to receiving the triggered signal.

2. The electronic ammunition of claim 1 wherein the shell is defined further as having a shape simulating the shape of the live ammunition and wherein the shell is adapted and shaped for loading in the ammunition firing device in a manner substantially like the live ammunition, the shell being held in a secured position by the ammunition firing device when the shell is loaded in the ammunition firing device.

3. The electronic ammunition of claim 1 wherein the electronic sound assembly is defined further to include:

a controller recorder having the live ammunition sound recorded therein and being adapted to receive the triggered signal, the controller recorder providing an output signal of the live ammunition sound in response to receiving the triggered signal; and a speaker assembly for receiving the controller recorder output signal of the live ammunition sound and providing the live ammunition sound in an audibly perceivable form.

4. The electronic ammunition of claim 3 wherein the electronic sound assembly is defined further to include:

an audio amplifier interposed between the speaker assembly and the controller recorder for receiving and amplifying the controller recorder output signal of the live ammunition sound and for providing the input to the speaker assembly of the live ammunition sound.

5. The electronic ammunition of claim 4 wherein the audio amplifier, the speaker assembly and the controller recorder each are defined further as being disposed and supported within the component space in the shell.

6. The electronic ammunition of claim 3 wherein the controller recorder is defined further as being adapted to provide an output signal to the recoil assembly in response to receiving the triggered signal, the triggered signal being provided to the recoil assembly via the controller recorder.

7. The electronic ammunition of claim 3 wherein the speaker assembly is defined further to include:

a forward speaker disposed near the forward end of the shell receiving the controller recorder output signal of the live ammunition sound and providing the live ammunition sound in an audibly perceivable form; and a rearward speaker disposed near the rearward end of the shell receiving the controller recorder output signal of the live ammunition sound and providing the live ammunition sound in an audibly perceivable form.

8. The electronic controller of claim 1 defined further to include:

a battery disposed in the component space in the shell and being connected to the electronic sound assembly for providing electrical operating power to the electronic sound assembly.

9. The electronic ammunition of claim 8 defined further to include:

means connected to the battery and having a portion extending through the shell for recharging the battery from a source external with respect to the component space in the shell.

10. The electronic ammunition of claim 1 wherein the electronic sound assembly is defined further as providing the audibly perceivable sound for a predetermined period of time and at a predetermined volume level simulating the sound of live ammunition when detonated.

11. Electronic ammunition for simulating live ammunition detonation when utilized with an ammunition firing device having a firing mechanism for firing ammunition when triggered, comprising:

a shell having a rearward end, a forward end, and a component space disposed generally between the forward and rearward ends thereof, an electronic sound assembly disposed in the component space in the shell having the sound of the live ammunition recorded therein (live ammunition sound) and adapted for providing the live ammunition sound in an audibly perceivable form in a play mode of the electronic sound assembly, the electronic sound assembly being conditioned in the play mode in response to receiving a triggered signal;

a firing assembly having a portion engagable with the firing mechanism of the ammunition firing device when the electronic ammunition is loaded in the ammunition firing device and when the ammunition firing device is triggered and another portion adapted to provide a triggered signal to the electronic sound assembly in response to the firing assembly being engaged by the ammunition firing device, thereby conditioning the electronic sound assembly in the play mode; and a recoil assembly disposed in the component space in the shell having a portion adapted for receiving the triggered signal from the firing assembly and being adapted to impart a simulated recoil action to the ammunition firing device in response to receiving the triggered signal, comprising:

a winch base;

a winch motor connected to the winch base for rotating the winch base in a winding direction in one condition of the winch motor and for rotating the winch base in an unwinding direction in one other condition of the winch motor, the winch motor being adapted to receive the triggered signal and to be conditioned for rotating the winch base in the unwinding direction in response to receiving the triggered signal;

a winch wire having one end connected to the winch base and an opposite end connectable to a portion of the ammunition firing device; and means for conditioning the winch motor to rotate the winch base in the winding direction for winding a portion of the winch wire about the winch base until there is a predetermined tension in the winch wire; and wherein the shell is adapted and shaped to be loaded in the ammunition firing device so the shell is securedly positioned in the ammunition firing device in a loaded position of the shell, the end of the winch wire opposite the end of the winch wire being connected to the ammunition firing device being connectable to the ammunition firing device in the loaded position of the shell and the winch motor being conditioned and the means for conditioning the winch motor to rotate the winch base in the winding direction in the loaded position of the shell and when the winch wire is connected to the ammunition firing deviee.

12. The electronic ammunition of claim 11 wherein the recoil assembly is defined further to include:

a recoil weight having a predetermined weight interposed in the winch wire.

* * * * *